United States Patent [19]

Buchegger et al.

[11] Patent Number: 4,630,785

[45] Date of Patent: Dec. 23, 1986

[54] COILER

[75] Inventors: Rudolf Buchegger, St. Florian; Rudolf Langeder, Mauthausen, both of Austria

[73] Assignee: Voest-Alpine Aktiengesellschaft, Linz, Austria

[21] Appl. No.: 742,743

[22] Filed: Jun. 10, 1985

[30] Foreign Application Priority Data

Jun. 18, 1984 [AT] Austria ..... 1972/84

[51] Int. Cl.[4] ..... B65H 75/24

[52] U.S. Cl. ..... 242/72.1

[58] Field of Search ..... 242/72 R, 72.1, 68.2; 279/2 R; 269/248.1; 72/148

[56] References Cited

U.S. PATENT DOCUMENTS

| | | | |
|---|---|---|---|
| 3,128,958 | 4/1964 | Bongiovanni et al. | 242/72.1 |
| 3,379,389 | 4/1968 | O'Keefe | 242/72.1 |
| 3,754,720 | 8/1973 | Gross et al. | 242/72.1 |
| 3,870,243 | 3/1975 | Briggs | 242/72.1 |

FOREIGN PATENT DOCUMENTS

| | | |
|---|---|---|
| 370777 | 9/1982 | Austria . |
| 941423 | 4/1956 | Fed. Rep. of Germany . |
| 2610511 | 9/1976 | Fed. Rep. of Germany . |

*Primary Examiner*—Stuart S. Levy
*Assistant Examiner*—David Werner
*Attorney, Agent, or Firm*—Kurt Kelman

[57] ABSTRACT

A coiler comprises an expanding core comprising a tubular coiler shaft and an expanding mechanism, which is accommodated in the tubular coiler shaft and operable to extend heatable extensible segments. Heat insulating material and cooling means are provided between the heatable part of the expanding core and the coiler shaft. In order to restrict the dissipation of heat. Pressure applying tubes having axes which are radial with respect to the coiler shaft are provided between the expanding mechanism and the extensible segments. The wall thickness of said pressure applying tubes increases toward the extensible segments. Cooling means are provided between the pressure applying tubes and the expanding mechanism.

8 Claims, 2 Drawing Figures

COILER

BACKGROUND OF THE INVENTION

1. Field of the Invention

This invention relates to a coiler having an expanding core, which comprises a tubular coiler shaft, a plurality of radially adjustably mounted, heatable extensible segments, an expanding mechanism, which extends in the tubular coiler shaft and is operable to extend the extensible segments, and heat insulating material and cooling means extending between the heatable portion of the expanding core and the coiler shaft.

2. Description of the Prior Art

In a coiler in which strip is coiled on a coiler core and is heated from the inside by the coiler core serving as a heater, a formation of scale at elevated temperatures can be substantially avoided and a substantial dissipation of heat can also be avoided. But in such coiler the coiler shaft and the expanding mechanism must be protected from an excessive heat load. For this purpose it is known from Austrian Patent Specification No. 370,777 to divide each extensible segment in height and to separate the two parts of each segment by heat insulating material so that the outer part of each extensible segment can be heated and its inner part can be cooled. In that case the heat which is transferred in spite of the heat insulation can be dissipated by the means for cooling the inner part of each extensible segment so that the expanding mechanism and the coiler shaft are protected from an excessively high heat load. But in such a coiler a heat transfer bridge is constituted by the pressure transmitting bars which are provided between the outer and inner parts of each extensible segment and extend throughout the length of said segment, and by the clamp screws by which the two parts of each extensible segment are forced together. Heat at an appreciable rate is dissipated via said heat transfer bridge and is not available for the reheating of the coiled strip.

SUMMARY OF THE INVENTION

It is an object of the invention to provide a coiler which is of the kind described first hereinbefore and which is so improved that the dissipation of heat via the cooling means can be minimized by the provision of structurally simple means.

The object is accomplished in accordance with the invention in that pressure transmitting tubes having axes which are radial with respect to the coiler shaft are provided between the expanding mechanism and the extensible segments, the wall thickness of the pressure applying tubes increases toward the extensible segments, and cooling means are provided between the pressure applying tubes and the expanding mechanism.

The pressure applying tubes provided between the expanding mechanism and the extensible segments have only a small area for the transfer of heat and nevertheless ensure a transmission of the required force. Because the wall thickness of the pressure transmitting tubes increases toward the extensible segments, the pressure applying tubes will contact the extensible segments on a sufficiently large area. On the other hand, the heat transfer through the pressure applying tubes will be minimized because their wall thickness decreases toward the expanding mechanism so that the ratio of the stress set up in the material of the pressure applying tube to its strength will be at least approximately constant over the length of the tubes as there will be a temperature gradient along said tubes. It will be understood that the cross-sectional area required to transmit a given force will increase with temperature.

The heat which is dissipated at a relatively low rate from the heated-up extensible segments via the specially shaped pressure applying tubes will be dissipated further by the cooling means provided between the pressure applying tubes and the expanding mechanism so that the latter will be effectively shielded against a transfer of heat from said tubes. Because heat can be dissipated by conduction only through the pressure applying tubes the coiler shaft will be reliably protected from excessively high heat loads if the coiler shaft is provided with appropriate heat insulating means and cooling means are provided between the coiler shaft and the heat insulating material. In such an arrangement a dissipation of heat at an excessively high rate from the heated-up extensible segments in a radially inward direction will be avoided.

A particularly simple design will be obtained if the pressure applying tubes associated with each extensible segment are mounted on a common base plate, which is connected to the expanding mechanism and is formed with coolant-conducting passages. Such base plates constitute simple cooling means between the pressure applying tubes and the expanding mechanism because it is not necessary to provide each pressure applying tube with coolant ports. Besides, those cooled base plates will shield the coiler shaft against radiant heat from the heated up extensible segments. To ensure that any heat at an excessive rate will not be dissipated from the cooled base plates by radiation, each base plate may be covered with heat insulating material on the side facing the extensible segments.

Heat can be conducted from the heated-up extensible segments to the coiler shaft and the expanding mechanism only through the pressure applying tubes so that the heat flux will be minimized. Said tubes have a wall thickness that varies along the tubes in a manner which is desirable in consideration of the temperature gradient. Whereas radiant heat is also emitted by said pressure applying tubes, a transfer of such radiant heat to the coiler shaft and/or to the expanding mechanism can be avoided in that the wall of each pressure applying tube is provided with heat insulating material on its inside and outside surfaces at least at that end which is close to the expanding mechanism.

Because there is a large temperature difference between the extensible segments when they have been heated up and the coiler shaft, the thermal expansion of the extensible segments must be taken into account in the design. For this reason the pressure applying tubes may be in sliding contact with the extensible segments so that the pressure applying tubes, which are fixed to the base plates, will not obstruct the thermal expansion of the extensible segments. The sliding contact between the pressure applying tubes and the extensible segments also facilitates the replacement of the extensible segments because they are not fixed to the pressure applying tubes by joints which must be released or established.

Because the pressure applying tubes are not fixed to the extensible segments, the pressure applying tubes may be disengaged from the extensible segments. Such disengagement will be prevented if compression springs are interposed between the pressure applying tubes and the expanding mechanism.

DETAILED DESCRIPTION OF THE PREFERRED EMBODIMENT

Figure 2:
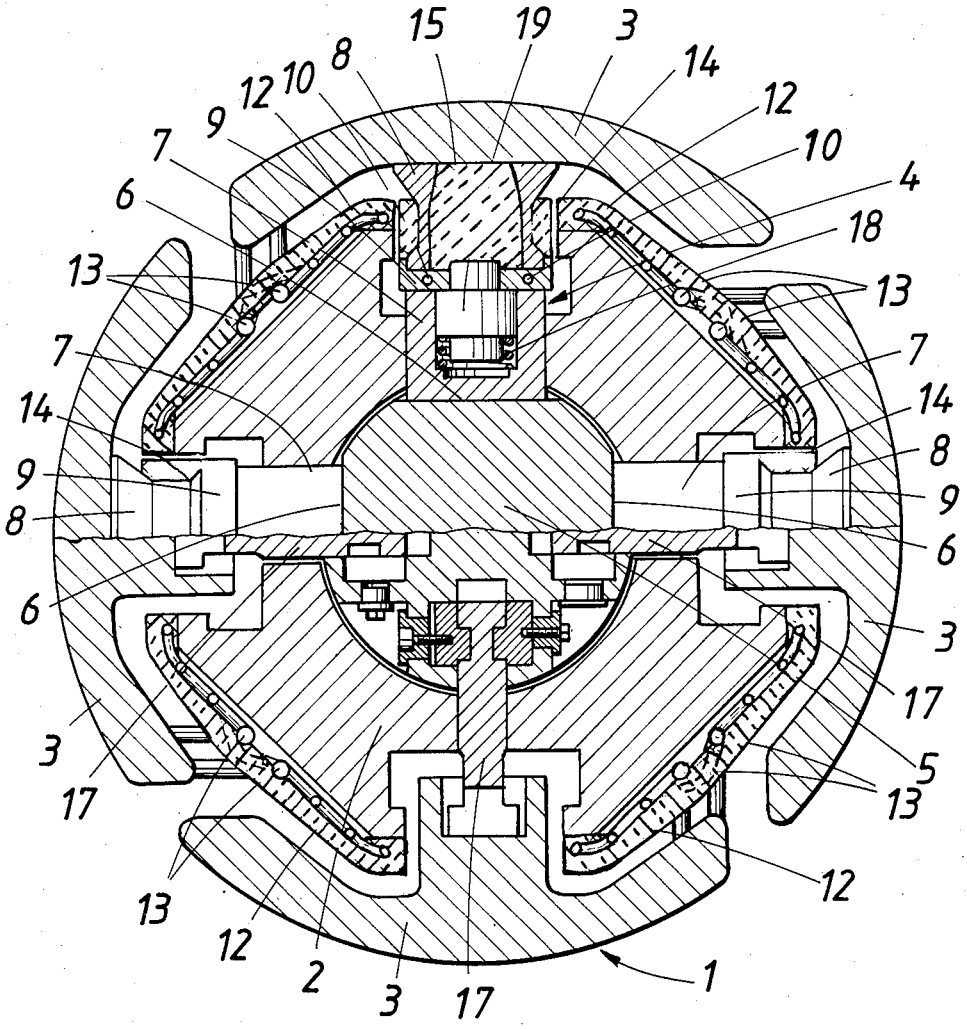
FIG. 2 is an axial sectional view taken on line II—II in FIG. 1 and showing that coiler core on a larger scale.

In the embodiment shown by way of example a coiler comprises a coiler core 1, which includes a tubular coiler shaft 2, radially adjustable, extensible segments 3 mounted on the coiler shaft 2, and an expanding mechanism 4 for radially extending and retracting the extensible segments. That expanding mechanism comprises in the usual manner an expanding rod 5, which is non-rotatably connected to the tubular coiler shaft 2 and is axially slidable therein and is formed with wedge faces 6 for adjusting expanding wedges 7, which are radially guided in the coiler shaft 2. The expanding forces are transmitted to the extensible segments 3 by means of pressure applying tubes 8, which are mounted on base plates 9, which are engageable by the expanding wedges 7. The wall thickness of each pressure applying tube 8 increases toward the associated extensible segment 3, as is particularly apparent from FIG. 2. That special design of the pressure applying tubes 8 has the result that a conduction of heat at a substantial rate from the extensible segments through the pressure applying tubes 8 will be prevented but the strength of the pressure applying tubes will not be unduly affected. Because the cross-section of each pressure applying tube 8 decreases toward the expanding mechanism 4, heat can be dissipated through the pressure applying tubes 8 only at a low rate. As a result, there will be a temperature gradient in each pressure applying tube. The solid cross-section of each pressure applying tube 8 is smaller in the region which is at a lower temperature than in the region which is at a higher temperature so that the ratio of the stresses set up in each pressure applying tube 8 to its strength will be substantially uniform at least in a major part of the length of the tube.

Figure 1:
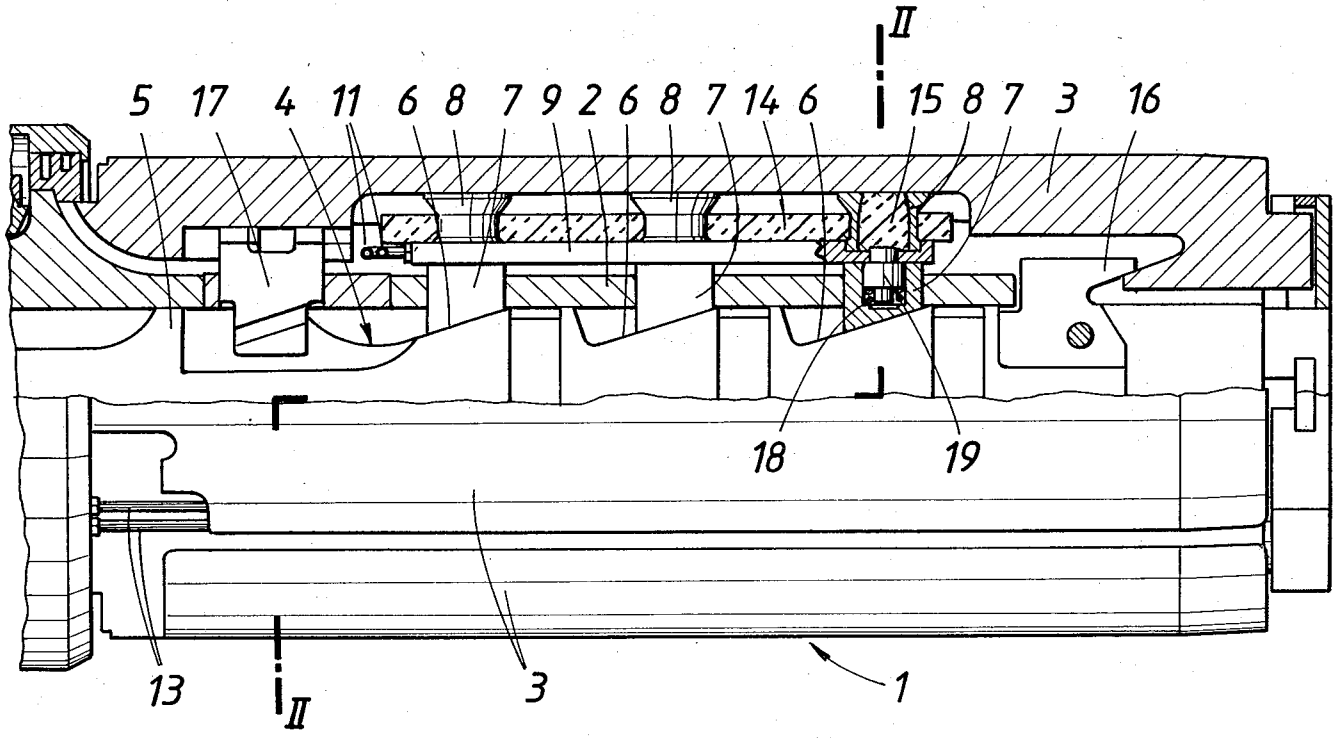
FIG. 1 is a side elevation, partly cut open, which shows the coiler core of a coiler which embodies the invention.

Heat which has been conducted by the pressure applying tubes 8 is dissipated by means of a coolant, which is conducted in coolant passages 10, which are formed in the base plates 9 and are connected by suitable lines 11 (FIG. 1) to a coolant circulating system not shown in detail. The extensible segments are adapted to be heated from external heating means. To protect the coiler shaft 2 against radiant heat from the hot extensible segments, those portions of the coiler shaft 2 which are not covered by the base plates 9 are covered with heat insulating material 12. Additional cooling means 13 also connected to the above-mentioned coolant circulating system are provided between the heat insulating material 12 and the coiler shaft and comprise suitable lines for conducting the coolant.

Each base plate 9 is also covered with heat insulating material 14 on its radially outer side around the pressure applying tubes 8 in order to restrict the dissipation of heat. For the same purpose, the inside and outside surfaces of the pressure applying tubes 8 are covered with heat insulating material. The heat insulating material covering the outside surfaces of the pressure applying tubes may consist of the heat insulating material 14 on the associated base plate 9. The inside surface of each pressure applying tube 8 may be covered with heat insulating material 15, which entirely fills the cavity of the pressure applying tube 8.

It will be understood that the extensible segments 3 will be non-rotatably connected to the coiler shaft 2 by the pressure applying tubes 8, the base plates 9 and the expanding mechanism 4 when the expanding wedges 7 force the pressure applying tubes 8 against the extensible segments 3.

The expanding mechanism 4 comprises retracting elements 16, 17, which are interposed between the expanding rod 5 and the extensible segments 3 and are operable by an axial movement of the expanding rod to retract the extensible segments 3 to their initial positions. During such operation the pressure applying tubes 8 may be disengaged from the extensible segments 3, which merely bear on the pressure applying tubes 8. Such disengagement would not adversely affect the operative condition of the coiler core. But that disengagement will be avoided if a compression spring 18 is interposed between each pressure applying tube 8 and the expanding mechanism 4. In the embodiment shown by way of example each compression spring 18 acts on the associated base plate 9 through the intermediary of a plunger 19 so that any backlash will be eliminated by the compression springs 18. When the force exerted to expand the coiler core overcomes the force exerted by the compression springs 18, said springs will be compressed until the expanding wedges 7 engage the base plates 9 so that the expanding wedges 7 will then act directly on the base plates 9 to move the latter as well as the pressure applying tubes 8 and the extensible segments outwardly in a radial direction.

The pressure applying tubes 8 engage the extensible segments 3 in an intermediate portion, which is adapted to be heated and will assume a higher temperature than the end portions where each segment is adapted to be acted upon by the retracting elements 16 and 17.

Because the extensible segments 3 are axially slidably mounted on the pressure applying tubes 8, the latter will not restrict the thermal expansion of the extensible segments 3 as they are heated up. Each extensible segment 3 may be fixed at one end to the coiler shaft 2.

The pressure applying tubes need not have the illustrated shape of a circular ring in cross-section but may have any cross-sectional shape which is suitable for a given application, for instance an oval or rectangular cross-sectional shape. The wall thickness of each pressure applying tube may increase toward the associated extensible segment to such an extent that the tube is closed at its radially outer end whereas the pressure applying tube is open at its inner end.

We claim:

1. In a coiler comprising an expanding coiler core comprising a tubular coiler shaft, a plurality of extensible segments, which are adapted to be heated and constitute an annular series surrounding said shaft and are mounted in said coiler core to be radially extensible and retractable, an expanding mechanism, which extends in said shaft and is movable along said shaft to radially extend and retract said extensible segments, and heat insulating material and cooling means extending between said extensible segments and said shaft and arranged to restrict the transfer of heat from said extensible segments to said shaft, the improvement residing in that a plurality of pressure applying tubes extend between each of said segments and said expanding mechanism, each of said tubes having an axis which is radial with respect to said coiler shaft and having a wall thickness which increases toward the associated extensible segment, and said cooling means extend between all of said pressure applying tubes and said expanding mechanism.

2. The improvement set forth in claim 1, wherein said expanding mechanism is adapted to non-rotatably connect said coiler shaft to said extensible segments via said cooling means and said pressure applying tubes.

3. The improvement set forth in claim 1 as applied to a coiler in which each of said extensible segments comprises a heatable portion that is adapted to be heated to a higher temperature than another portion of said extensible segment and said heat insulating material and said cooling means extend between said heatable portions of said extensible segments and said expanding mechanism, wherein said pressure applying tubes engage said extensible segments at said heatable portions thereof.

4. The improvement set forth in claim 1, wherein said cooling means comprise a plurality of base plates, which are formed with coolant conducting passages and each of which is connected to said expanding mechanism and to said pressure applying tubes connected to one of said extensible segments.

5. The improvement set forth in claim 4, wherein said base plates are covered on their radially outer side with heat insulating material around said pressure applying tubes.

6. The improvement set forth in claim 1, wherein each of said pressure applying tubes is covered on its inside and outside surfaces with heat insulating material at least at its radially inner end.

7. The improvement set forth in claim 1, wherein said pressure applying tubes are in sliding contact with said extensible segments.

8. The improvement set forth in claim 7 as applied to a coiler in which said expanding mechanism comprises means for radially retracting said extensible segments in response to an axial movement of said expanding mechanism to a predetermined position, wherein said pressure applying tubes are radially movable when said expanding mechanism is in said predetermined position and compression springs are provided between said pressure applying tubes and said expanding mechanism and arranged to urge said pressure applying tubes radially outwardly when said expanding mechanism is in said predetermined position.

* * * * *